US006817553B2

(12) United States Patent
Steur

(10) Patent No.: US 6,817,553 B2
(45) Date of Patent: Nov. 16, 2004

(54) POWDER PAINT SPRAY COATING APPARATUS HAVING SELECTABLE, MODULAR SPRAY APPLICATORS

(75) Inventor: Gunnar van der Steur, Chesapeake City, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 5 days.

(21) Appl. No.: 10/357,945

(22) Filed: Feb. 4, 2003

(65) Prior Publication Data

US 2004/0159724 A1 Aug. 19, 2004

(51) Int. Cl.[7] ..... B05B 5/00; F23D 11/32

(52) U.S. Cl. ..... 239/690; 239/223; 239/224; 239/436; 239/443; 239/694; 239/695; 239/700; 239/525; 239/569; 239/587.1; 239/390

(58) Field of Search ..... 239/223, 224, 239/390, 391, 392, 393, 394, 396, 397, 436, 442, 443, 444, 446, 447, 525, 569, 587.1, 690, 694, 695, 696, 697, 698, 699, 700, 702, 703, 704, 706, 707, 708; 901/30, 41, 43

(56) References Cited

U.S. PATENT DOCUMENTS 4,248,379 A * 2/1981 Hollstein et al. ..... 239/704
4,692,358 A 9/1987 Marsden et al.
4,821,673 A * 4/1989 Kirigakubo et al. ..... 901/43
4,909,180 A 3/1990 Oishi et al.
5,058,805 A 10/1991 Anderson et al.
5,064,123 A * 11/1991 Aiello et al. ..... 239/706
5,320,283 A 6/1994 Hollstein et al.
5,636,798 A * 6/1997 Buschor ..... 239/696
6,032,871 A 3/2000 Borner et al.
6,045,053 A * 4/2000 Ruud ..... 239/436
6,105,886 A * 8/2000 Hollstein et al. ..... 239/700
6,589,342 B2 * 7/2003 Attinoto et al. ..... 118/308

* cited by examiner

*Primary Examiner*—Robin O. Evans
(74) *Attorney, Agent, or Firm*—E. Alan Uebler, PA

(57) ABSTRACT

Apparatus for the electrostatic powder paint spray coating of substrates, such as automotive vehicles, is provided. The apparatus includes modular applicators which are mountable into a programmable, robotically controlled housing. The modular applicators are switchable into and out of an operational mode on command, to facilitate different optimal coating procedures for coating differing surfaces, ranging from large, open surfaces to smaller, highly irregular substrate surfaces. The applicator heads may be spatially switchable on command from, for example, a bell cup spray applicator to a spray gun applicator. Flow control to each applicator is preferably enhanced using selectable pneumatically controlled pinch valves.

14 Claims, 4 Drawing Sheets

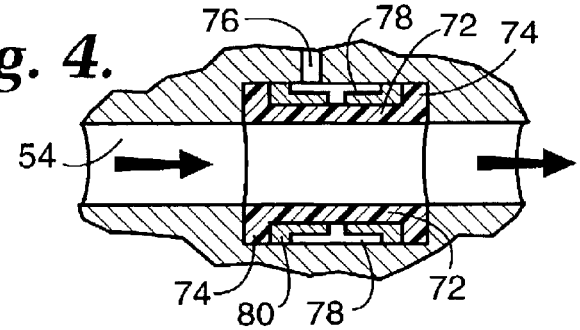
Fig. 4.
Fig. 5.
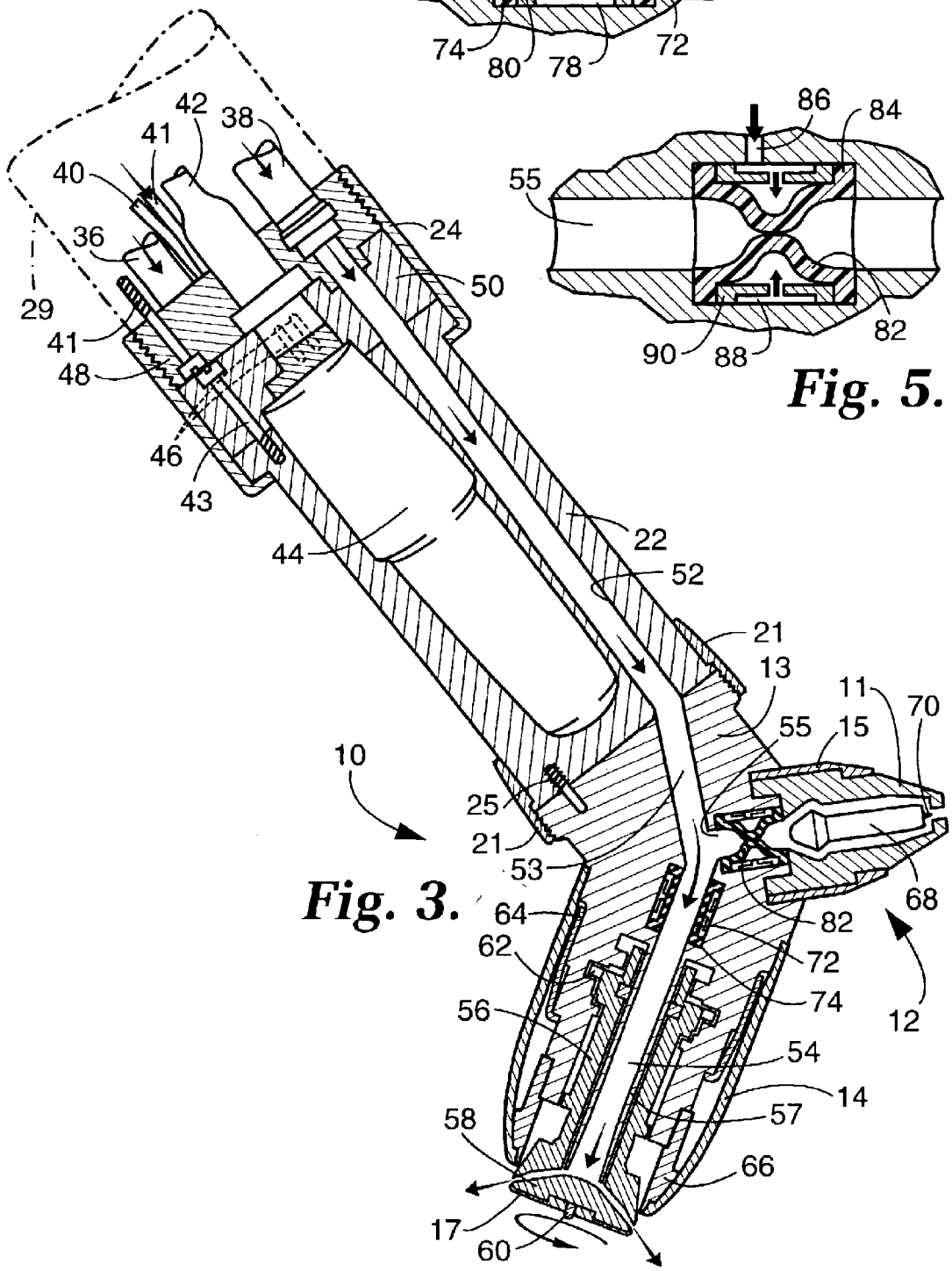
Fig. 3.

POWDER PAINT SPRAY COATING APPARATUS HAVING SELECTABLE, MODULAR SPRAY APPLICATORS

FIELD OF THE INVENTION

The invention relates to the powder paint spray coating of substrates using modular applicators mountable into a programmable, robotically maneuvered housing.

BACKGROUND OF THE INVENTION

Electrostatic spray applicators are widely used in the coating industry for powder spray coating of substrates such as automotive vehicles. Spray gun applicators mounted on programmable robots used in automated production lines are advantageous in applying uniform coatings of powder to irregularly shaped substrates. Alternatively, rotary electrostatic spray applicators, known as bell cup applicators, may be used for applying powder paint coatings to larger areas of substrates. Such bell cup powder applicators are affixed to turbine housings through which is fed the powder to be sprayed in the form of an air-powder mixture under pressure. Various bell cup applicators are known and are disclosed and described, for example, in my commonly assigned, co-pending U.S. patent application Ser. No. 09/993,011, incorporated herein by reference.

In such applications, the coating material is generally applied as a fine powder spray which is, after coating, subsequently baked in a vehicle paint oven to form a durable, finished coating thereon. As a substrate to be coated passes the applicator assembly, electrically charged powder particles are discharged in a dust form. The ionized powder particles are attracted to the electrically charged (grounded) substrate, thereby providing an evenly distributed coating on the substrate.

Spray gun applicators, which are generally used to spray coat a more narrowly defined and irregular surface, are normally affixed through a wrist component to the end of a robot arm, and dual spray-head guns for such applications are known. See, for example, U.S. Pat. No. 5,320,283.

Also known are apparatus and a method for liquid paint spraying, as compared and contrasted with powder coating, wherein two paint spray guns are mounted on a common manifold block. Shaping air, atomizing air and paint are fed to the guns. Each gun is individually controlled by a respective solenoid valve and, during operation, a selected one of the spray guns is robotically positioned adjacent a surface to be painted and then operated to apply paint. See, for example, U.S. Pat. No. 4,692,358.

The powder coating apparatus of the present invention, in contrast to the known prior art, provides a plurality of modular, robotically maneuvered, differing powder applicators, all removably mounted in a common housing and connected to a common powder supply. On demand, the coating operation can be switched nearly instantaneously from the use of a spray gun applicator to the use of a rotary bell cup applicator, and vice versa.

SUMMARY OF THE INVENTION

Electrostatic spray apparatus for applying powder coatings to substrates is provided. The apparatus includes a universal main wrist receptacle means removably affixed to the end of a multi-axial, three dimensionally maneuverable arm. The receptacle means has attached thereto a modular rotary bell cup powder spray applicator. The receptacle means has, in addition, connection means to which a modular powder spray gun applicator may be optionally and removably affixed. The apparatus includes means for spatially switching from one applicator to the other applicator such that a selected one of the applicators may be positioned adjacent a substrate for coating, on command. The apparatus includes control means for selectively controlling the supply of spray powder to a selected one of the applicators, on command. A supply of powder is maintained in flow communication with whichever applicator is operational.

The receptacle preferably has both a modular rotary bell cup applicator and a modular spray gun applicator, each removably affixed thereto.

The optional spray gun applicator may be omitted and in its connection a removable plug may be inserted. The switching command may be effected electrically or pneumatically.

Control valves are provided which control the flow of powder supplied to the bell cup applicator and to the spray gun applicator, on command. The control valves may be controlled electrically or pneumatically. Preferably, the control valves are pneumatically sealable pinch valves.

BRIEF DESCRIPTION OF THE DRAWINGS

In the accompanying drawings:

FIG. 3 is an enlarged cross-sectional view of one embodiment of the invention in a first operational mode, wherein powder is being sprayed onto a substrate by a rotary bell cup applicator;

Figure 6:
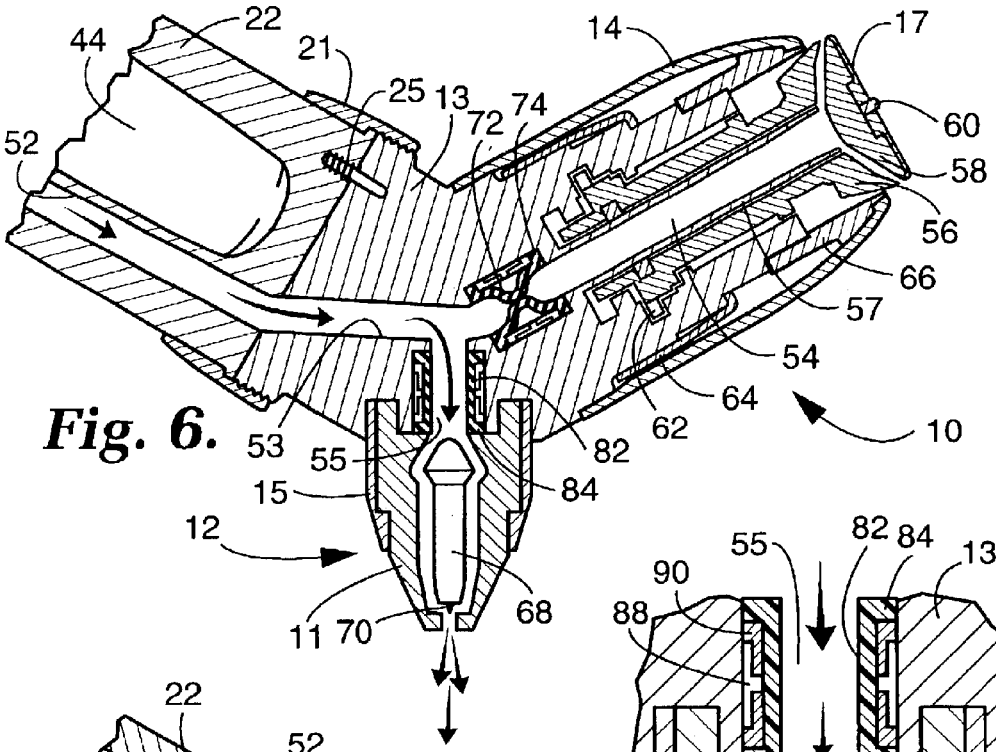
Figure 7:
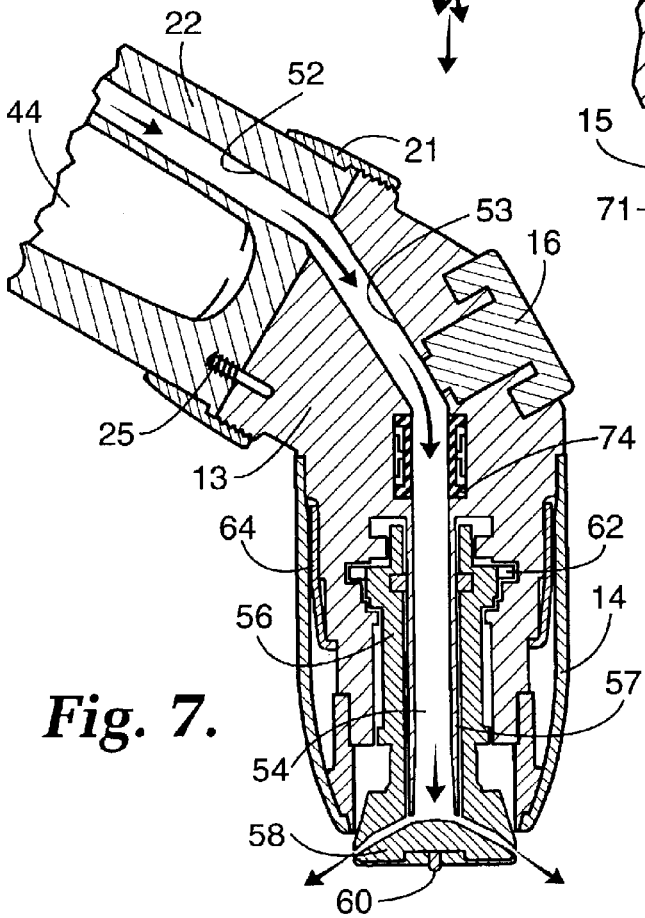
Figure 8:
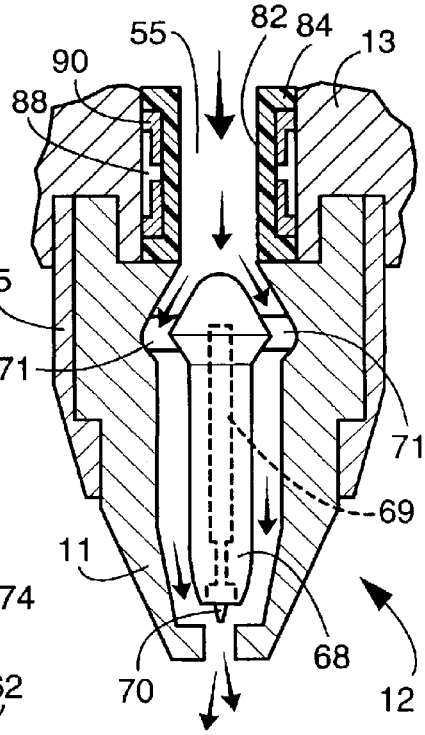
Figure 9:
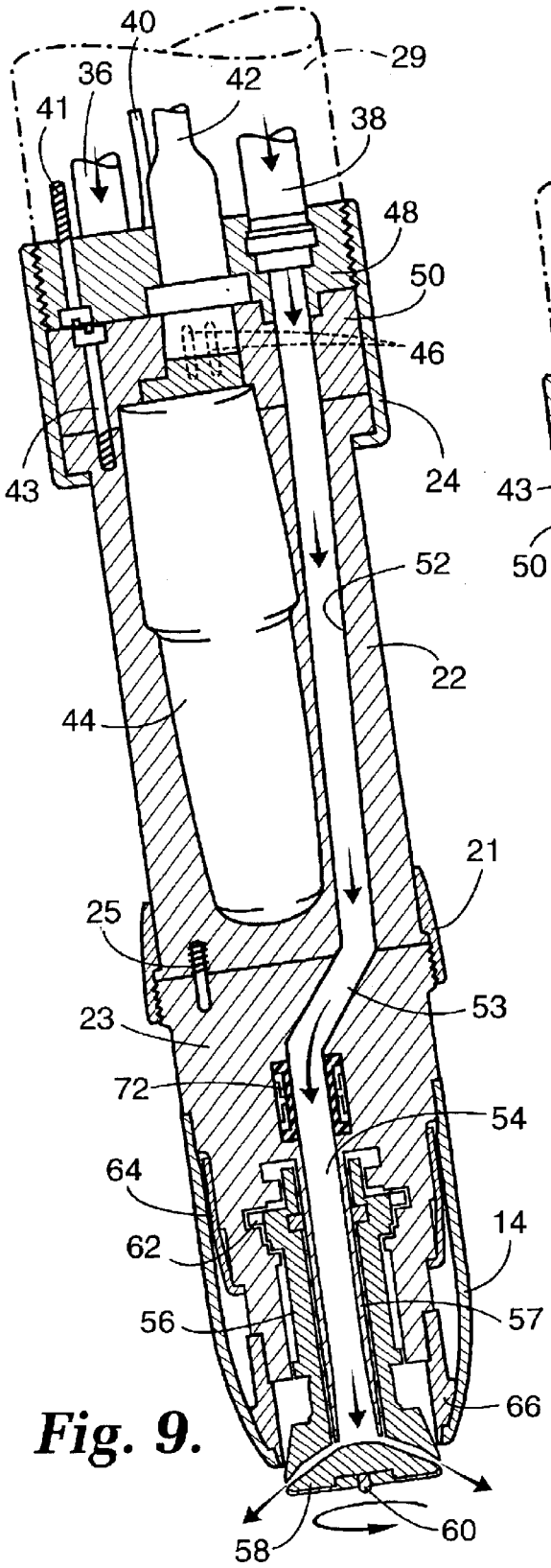
Figure 10:
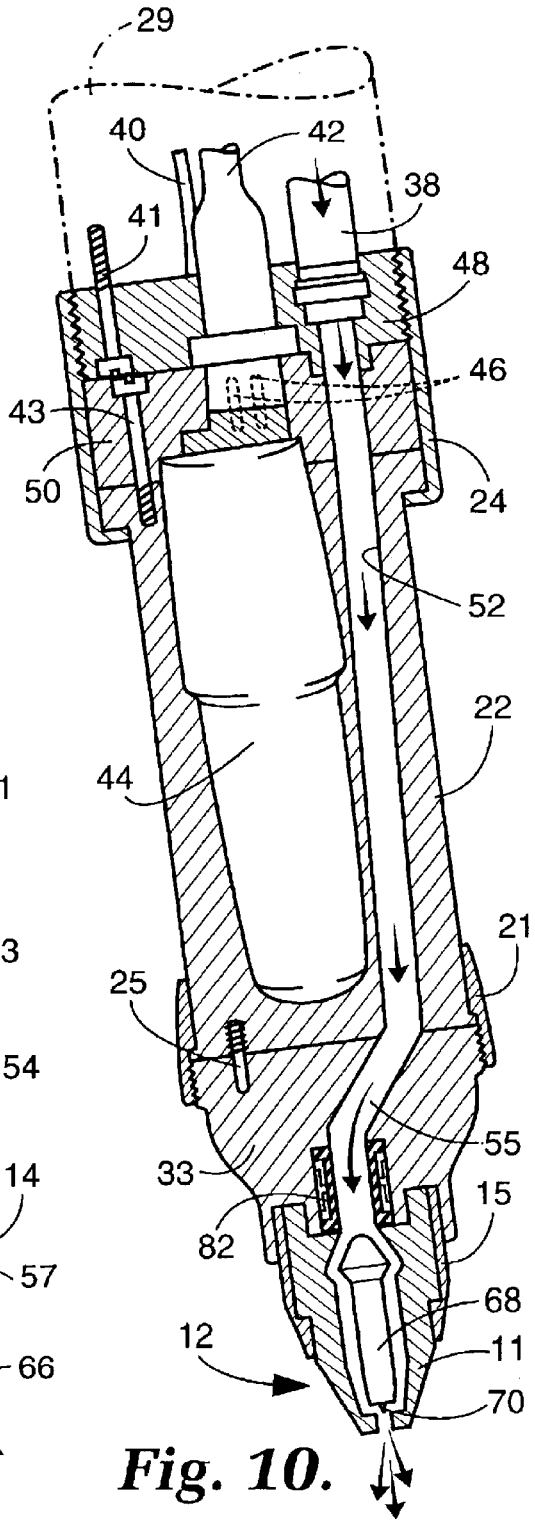

FIG., 4 illustrates, in cross-section, one pneumatic valve suitable for controlling the powder flow to one applicator of the invention, shown in the valve-open mode;

FIG. 5 shows the valve of FIG. 4 wherein pneumatic pressure is applied forcing the valve to its closed mode;

FIG. 6 illustrates, in cross-section, the apparatus shown in FIG. 3 in an alternate operational mode, wherein powder is being sprayed onto the substrate by a spray gun applicator;

FIG. 7 is a still further embodiment, shown in cross-section, wherein a plug is inserted to seal the receptacle connection means of the invention in place of the spray gun applicator depicted in FIG. 3;

FIG. 8 illustrates, in cross-section, the powder flow to and through the spray gun applicator, showing the pneumatically controllable pinch valve in the "open" position;

FIG. 9 shows the embodiment of the invention, in cross-section, in which a pneumatic pinch valve controls the flow to a single rotary bell cup applicator; and FIG. 10 shows an embodiment, in cross-section, wherein a pneumatic valve controls the powder flow to a single spray gun applicator.

DETAILED DESCRIPTION OF THE INVENTION AND PREFERRED EMBODIMENTS WITH REFERENCE TO THE DRAWINGS

Apparatus for the electrostatic powder paint spray coating of substrates, such as automotive vehicles, is provided. The apparatus includes modular applicators which are mountable into a programmable, robotically controlled housing. The modular applicators are switchable into and out of an operational mode on command, to facilitate different optimal coating procedures for coating differing surfaces, ranging from large, open surfaces to smaller, highly irregular substrate surfaces. The applicator heads may be spatially switchable on command from, for example, a bell cup spray applicator to a spray gun applicator. Flow control to each applicator is preferably enhanced using selectable pneumatically controlled pinch valves.

Figure 1:
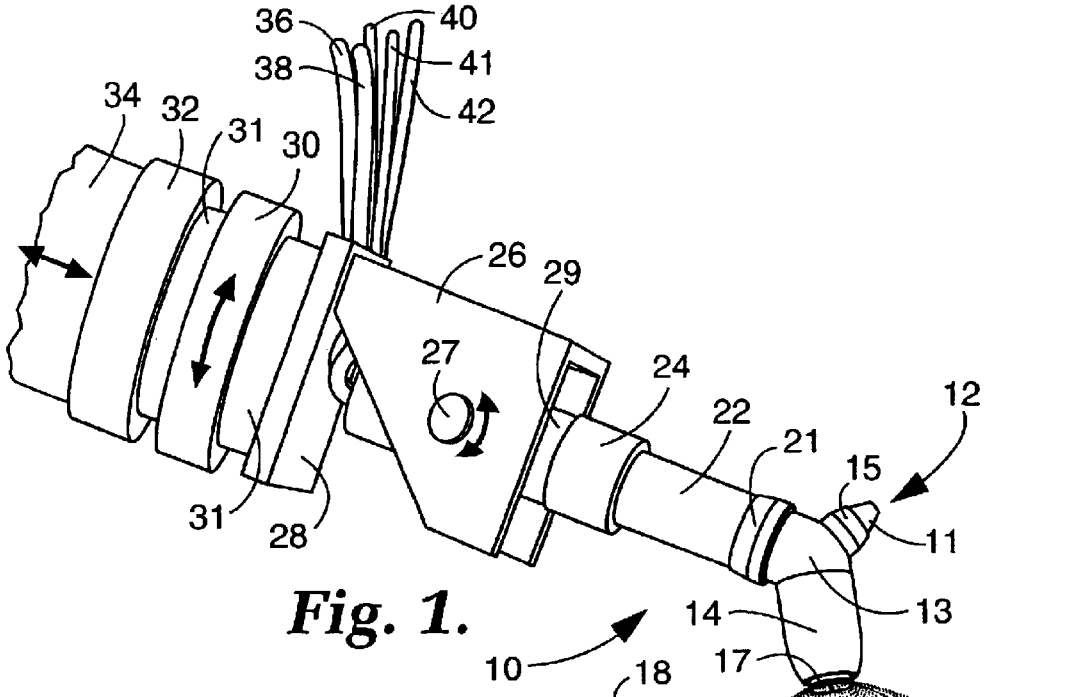
FIG. 1 is a perspective view of the spray coating apparatus of the invention attached to the end of a multi-axially maneuverable robotic arm and showing its housing and air/powder supply lines.

A detailed description of the invention and preferred embodiments is best provided with reference to the accompanying drawings wherein FIG. 1 shows a schematic perspective view of an embodiment 10 of the invention in operation and spray coating a substrate 18 using a rotary bell cup applicator head 14. In this embodiment, the coating powder 20 is applied as a fine spray as the substrate 18 passes in proximity to the applicator 14. As the substrate 18 passes the bell cup applicator assembly, the electrically charged powder particles, discharged in mist-like form, are attracted to the electrically grounded substrate 18 to provide an evenly distributed coating on the substrate 18. The bell cup applicator 14 with rotating deflector 17, described more fully below, causes the powder to be discharged uniformly over the substrate 18. The powder 20 is supplied to the applicator through powder supply line 38 and is fed into and through the arm 29 and the robotic arm paint extension assembly 22, to which is affixed the applicator-module-receiving receptacle 13 of the universal applicator assembly housing 10 by means of connector 21. Into receiving means in wrist receptacle 13, also depicted in more detail below, are affixed multiple modular applicator heads such as the rotary bell cup applicator 14 and a spray gun applicator 12 all mounted onto the end of the robot arm extension assembly 22. The movement in space of the wrist receptacle 13 is controlled robotically in three dimensions by means of the pivoting housing mechanism 26 and pivot 27 (up and down), connected thereto by quick disconnect connector sleeve 24 which is, in adjacent connection, affixed to base connector 28, rotatable in space by means of rotating joint 30 affixed thereto by extension joint 31. The robot arm 34 is also axially movable and controllable in space in a direction along the central axis of the arm, all possible movements of the components being indicated schematically by the double headed arrows shown in FIG. 1. To complete the schematic, an air line 36 supplies air to power the turbine of the bell cup 14, an electric line 42 supplies the electric power for charging the powder particles, and air lines 40 and 41 provide pneumatic power for switching of the preferred control valves used to control the flow of powder to one or the other of the applicator heads 12, 14.

Figure 2:
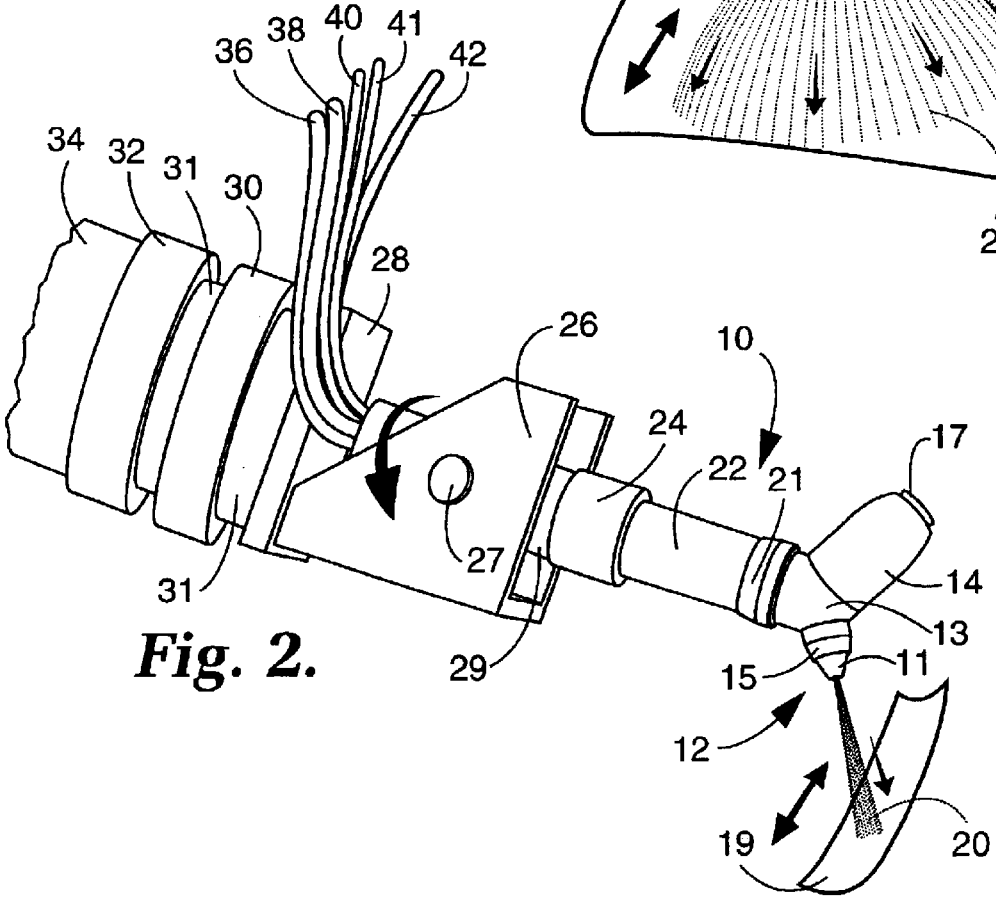
FIG. 2 shows, in perspective, the apparatus of FIG. 1 switched in space to an alternate applicator configuration.

FIG. 2 depicts the configuration of the apparatus of the invention as in FIG. 1 but with the applicators 12 and 14 switched spatially such that powder 20 is being sprayed onto a smaller, more detailed substrate 19 by means of the spray gun nozzle applicator 12, affixed to the universal wrist receptacle 13 by means of connector 15. The spatially rotatable joint has been turned through approximately 180°, thereby inverting housing 26 and positioning the applicators 12, 14, and adjusting the powder supply (not seen in this figure) to cause the powder to be sprayed as shown, generally in the form of a relatively narrow conical spray 20 onto the substrate 19. The other components are as described in FIG. 1.

FIG. 3 is a cross-sectional view of the electro-static spray apparatus of the invention showing in greater detail the universal main wrist receptacle 13 affixed to the end of the robot arm extension assembly 22 by screw threaded sleeve connector 21. Removably inserted into the receptacle 13, as shown, is the spray gun applicator 12. Pin 25, mounted on arm 22 and fitting into a bore in receptacle 13 keeps the powder supply channels 52, 53 in registry at all times. Powder flow to and through the applicator 12 from the main supply channel 52 is controlled by the on-off pinch valve 82, described in detail below, shown in FIG. 3 in the closed and "off" position. The spray gun assembly 12 is held in place in receptacle 13 by connector 15 via a threaded connection, the threads not shown in the figure.

Shown integral with receptacle 13 in FIG. 3 is the turbine driven bell cup rotary spray applicator assembly, including the turbine 56 driven by turbine blades 62 and rotating within the cavity shown in receptacle 13. The air/powder mixture supplied through channel 52 is fed into the rotating turbine 56 and impinges on the rotating deflector 58. The turbine body is housed within the receptacle 13 and the air/powder mixture passes therethrough to the bell cup assembly mounted at the forward end thereof, maintained at a high voltage. The powder passing axially through the turbine housing 56 impinges on deflector 58, at which point it is redirected radially outwardly therefrom, as indicated by the arrows, forming the aforesaid powder mist used to coat various substrates.

The bell cup is shaped generally as a truncated frusto-conical body member, with its smaller diameter end oriented toward the turbine air/powder supply, and its larger diameter end flaring outwardly to its periphery. Spaced apart from the bell cup, and forming a uniform gap at the periphery thereof, is the deflector 58, which has a convex surface and which, in cooperative alignment with the bell cup, forms an annular, tapering passageway extending from the central, axial air/powder delivery passageway and tapering to an outer, peripheral uniform gap, from which the powder is ejected to coat a substrate passing thereby.

A coaxial discharge nozzle 57 extends through the pneumatically powered turbine 56 and provides a passageway for the air-powder mixture. The bell cup coaxial discharge nozzle 57 runs centrally through but not connected to the rotating turbine 56. Affixed to, and in cooperative alignment with, the end of the turbine is the smaller diameter end of the bell cup. Spaced apart from the bell cup is the deflector 58, the bell cup and deflector together forming the annular passageway tapering out to the periphery. The air-powder mixture is dispensed onto the interior surfaces of the bell cup, which is rotated by the turbine, and travels by centrifugal forces out the gap in the periphery of the bell cup and out into the atmosphere. The front faceplate 17 of the bell cup is electrically conductive and connected to an ionizing source, housed elsewhere in the system, and houses the emitting electrode 60 extending externally from the axial center of the bell cup. The emitting electrode 60 charged by the ionizing source creates an ionized field into which the powder particles, having exited the bell cup and into the atmosphere, enter and become charged. The ionized powder particles are thence attracted to the electrically charged (grounded) substrate to provide an evenly distributed coating on the substrate. The powder particles may be further influenced toward the grounded substrate by means of compressed air (referred to as "shaping air"), not shown, that flows from an externally supplied source through passages in the system and the module, to a cavity that is created by an outer shroud 14 that covers and encompasses the pneumatic turbine. The shroud 14 is generally conically shaped and connected, on one end, to the module by means of screw threads that are coaxial with the rotary bell cup applicator, and on the other end mates against an inner shroud 66 that is connected to and is coaxial with the pneumatic turbine. The mating surface between the inner shroud and the outer shroud is an angular diameter surface that seals the internal cavity between the outer shroud, inner shroud, and the module. The shaping air pressurizes this cavity and the air flows out of the cavity through small holes or slits that are set out radially and generally parallel or at a slight angle from parallel at or near the angular mating surfaces of the outer and inner shrouds, whose location is just aft of, and diametrically larger than, the exiting gap at the periphery of the bell cup, where the powder enters the atmosphere. The shaping air impinges on the ionized powder particles and forces it forward of the rotary atomizer, parallel to its axis, and toward the substrate being coated.

Powder flow into the turbine bell cup applicator from inlet channel 52 and is controlled by the on-off pinch valve 72, described in detail below, shown in FIG. 3 in the "on" or "open" position, thereby directing all of the powder to and through the bell cup applicator.

The receptacle 13, as described with reference to FIG. 1, is threadingly engaged with the end of robot arm 22 by means of threaded connector 21. The powder supply line 38, electrical supply lines 42, turbine air supply 36 and pneumatic valve control air lines 40 and 41 are all included for completeness, as are the electrical cascade 44 and electrical connectors 46, all shown schematically and eliminating detail.

The pneumatically operated membrane pinch valves 72 and 82 are depicted in cross-section in FIGS. 4 and 5. In the system shown in FIGS. 1–3, two applicator ports 54 and 55 extending from the distal end of supply port 53 for discharging an air-powder mixture to a selected one of the two applicators are shown. The two ionized applicator ports are separated some distance from each other in order to allow each applicator port to be used separately, one port discharging, by means of an attached applicator, the air-powder mixture while the other port is closed. Powder flow through the two ports is controlled by the tube shaped, flexible membranes 72,82 with flared flange ends 74,84. These membranes can be made of a material having elastomeric properties that constrict the tubes under a pneumatic force. Each membrane has an associated cylindrical collar 80,90, having undercuts 78,88 as shown, encasing its outside diameter between the membrane's flared ends. These collars preferably have the undercuts 78,88 and a series of intersecting holes around their circumferences and midway along their lengths. The membranes, along with the attending collars, fit into the cylindrical coaxial cavities in the powder supply tubes 54,55, as shown, with the powder supply tubes and the internal diameters of the membrane valves having equal diameters. The cavity into which each membrane valve and its associated collar are housed is pneumatically sealed by the flared ends 74,84 of the membrane. The cavity in which the membrane and its collar are housed is externally connected via inlets 76,86 to an air supply (not shown) through which compressed air of sufficient pressure may flow that causes the membrane to deform and constrict toward its center axis to the extent that the internal diameter of the membrane is closed off to the flow of the air-powder mixture therethrough. The intersecting pneumatic line is connected to a source of compressed air and runs through a pneumatic switch that turns the supply of compressed air on and off on command.

FIG. 4 shows one pinch valve 72 positioned in powder supply channel 54 in the "open" position, in the absence of applied pneumatic pressure. FIG. 5 shows another pinch valve 82 positioned in powder supply channel 55 in the "closed" or "shut" position, under the force of applied compressed air as indicated by the vertical arrows shown in the figure.

FIG. 6 depicts a preferred embodiment of the dual headed applicator system 10 affixed to the end of a controllable robot arm paint extension assembly 22, all according to the principles of the invention. FIG. 6 is a cross-sectional view depicting the apparatus rotated spatially through 180° from that of FIG. 3 and reflects the orientation shown in FIG. 2. Specifically, to the end of the robot arm paint extension assembly 22 is threadingly connected the receptacle 13 removably affixed thereto by threaded connector 21. The dual spray applicators are switched such that the air/powder feed, indicated by the arrows, is directed through passageway 52 into passageway 54 and, because the pinch valve 72 has been closed, the powder is diverted into passageway 55 and thence to and through the spray gun assembly 12. The pinch valve 82 is in the full "open" position, and all spraying is being effected by the spray gun. The powder spray gun has a coaxial center deflector 68 that mates adjacent the exiting flange 84 of the membrane valve 82 and extends forward of the discharging applicator port 55. The center deflector 68 creates an annular passageway around it formed as a central axial opening, initially of the same diameter as the valve opening, which then flares out relative to the central axis. This passageway provides a channel for the air-powder mixture to travel from the valve and around the base of the candle-shaped electrode that runs axially inside the central cavity. This central cavity is formed by the internal diameters of an air cap 11, as shown. The air cap 11 is coaxial with the center deflector 68 and has a flange that allows the air cap 11 to rest on the exit face of the center deflector. The flange keeps the air cap 11 coaxial to the center deflector 68. The air cap 11 is mated to the module 13 by means of a hold down ring 15 that slips over the air cap and allows the air cap to protrude through it. It has screw threads that mate to corresponding screw threads in the module and a flange on its internal diameter to force the air cap and the center deflector to be pressed down against the module 13 as the threads on the hold down ring are engaged into the mating threads in the module. The air cap's internal configuration forms the central cavity into which the aforementioned passageways formed by the center deflector exit. The candle-shaped electrode 69 that lies coaxially in the central cavity is connected to an ionizing source, housed elsewhere in the system, and has an electrode tip 70 that protrudes toward the forward end of the central cavity. The air cap's forward end has a slot that is perpendicular to the central axis and intersects the forward end of the central cavity and provides an exit port to the atmosphere for the air-powder mixture that entered the central cavity from the passageways of the deflector. As the air-powder mixture is transported through the central cavity and around the candle shaped electrode, the powder particles become charged by the protruding electrode tip just before they exit the spray gun through the slot in the forward end of the air cap. The ionized powder particles are attracted to the electrically charged (grounded) substrate to provide an evenly distributed coating on the substrate, which may have a highly irregular surface contour.

The rotary bell cup applicator is shown disengaged in FIG. 6, with flow of powder to it shut off by the closed pinch valve 72.

An alternate arrangement, useful in instances wherein large surfaces are to be coated and the spray gun applicator is not required, is shown in FIG. 7, wherein a plug 16 is placed into the receiving aperture in receptacle 13 into which the spray gun also inserts when required. The plug 16 and the spray gun connector 15 have common threads.

FIG. 8 shows in enlarged detail, in cross-section, the spray gun assembly 12 of FIG. 6, including the central (dashed) electrode 69 within the deflector 68. Struts 71 mount the deflector 68 within the central cavity of the spray gun assembly 12. The various arrows depict the direction and, to an extent, the quantity of powder passing through the passageways. The valve 82 is seen in the "open" position.

On occasion, it may be desirable to employ one or the other of the rotary bell cup applicator or the spray gun applicator singly, with no requirement or desire that they be switchable from one to the other. These configurations are represented in FIGS. 9 and 10, respectively. In each configuration, pinch valves 72, 82 are used to control the powder flow, either on or off. In both instances, the valves are shown in the "on" or open configuration. Each of the applicator heads, the rotary bell cup and the spray gun, is shown as removably attachable to the robotic arm paint extension assembly 22 by means of a common threaded connecting sleeve 21. In these configurations, the rotary bell cup and the spray gun are interchangeable, as desired or needed.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Electrostatic spray apparatus for applying a powder paint coating to substrates, said apparatus comprising:

universal main wrist receptacle means removably affixed to the end of a multi-axially controllable arm, said receptacle means having attached thereto:

a modular rotary bell cup powder spray applicator, said receptacle means also having connection means to which a modular powder spray gun applicator is optionally and removably affixed, said apparatus having means for spatially switching from one said applicator to the other applicator such that a selected one of said applicators is positioned adjacent said substrate for coating, on command, and including control means for selectively controlling the supply of said spray powder to a selected one of said applicators, on command.

2. The apparatus of claim 1 wherein said receptacle means has a spray gun applicator removably affixed thereto.

3. The apparatus of claim 1 wherein said wrist receptacle has a modular rotary bell cup applicator and a modular spray gun applicator both removably affixed to said receptacle.

4. The apparatus of claim 1 wherein said optional spray gun applicator is omitted and in said connection a removable plug is inserted.

5. The apparatus of claim 1 wherein said switching command is effected electrically.

6. The apparatus of claim 1 wherein said switching command is effected pneumatically.

7. The apparatus of claim 1 including a control valve which controls the flow of powder supplied to said bell cup applicator.

8. The apparatus of claim 1 including a control valve which controls the flow of powder supplied to said spray gun applicator.

9. The apparatus of claim 7 wherein said control valve is controlled electrically.

10. The apparatus of claim 8 wherein said control valve is controlled electrically.

11. The apparatus of claim 7 wherein said control valve is controlled pneumatically.

12. The apparatus of claim 8 wherein said control valve is controlled pneumatically.

13. The apparatus of claim 11 wherein said control valve is a pneumatically sealable pinch valve.

14. The apparatus of claim 12 wherein said control valve is a pneumatically sealable pinch valve.

* * * * *